US008215990B2

(12) United States Patent
Ho

(10) Patent No.: US 8,215,990 B2
(45) Date of Patent: Jul. 10, 2012

(54) ELECTRICAL CONNECTOR

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/178,134

(22) Filed: Jul. 7, 2011

(65) Prior Publication Data

US 2012/0009822 A1 Jan. 12, 2012

(30) Foreign Application Priority Data

Jul. 7, 2010 (TW) ..... 99212956 U
Jul. 7, 2010 (TW) ..... 99212957 U

(51) Int. Cl.
*H01R 13/648* (2006.01)

(52) U.S. Cl. ..... 439/607.05

(58) Field of Classification Search ..... 439/607.05, 439/607.07, 607.09, 607.13, 607.46, 660
See application file for complete search history.

(56) References Cited

U.S. PATENT DOCUMENTS

2012/0009822 A1* 1/2012 Ho ..... 439/626
2012/0021651 A1* 1/2012 Ho ..... 439/626
2012/0040567 A1* 2/2012 Ho ..... 439/660
2012/0052709 A1* 3/2012 Ko ..... 439/345

* cited by examiner

*Primary Examiner* — Tulsidas C Patel
*Assistant Examiner* — Phuongchi Nguyen
(74) *Attorney, Agent, or Firm* — Stephen L. Sheldon

(57) ABSTRACT

An electrical connector comprises a housing, a plurality of first terminals, a plurality of second terminals, a plurality of third terminals and a cage provided on the exterior of the housing. The housing comprises a base and a tongue. The base is provided with a base wall and an assembly slot provided on the base wall to which the mated tongue mates. The tongue is provided with a body and a plurality of terminal installation slots recessed downward at intervals from the top surface of the body, the rear end of the terminal installation slots being defined by a boss part. A yield notch is provided at each location where each terminal passageway corresponds to the boss part. Because the boss parts increase the strength of the tongue, and by utilizing the yield notches, the contacts are able to prevent the boss parts from entering the terminal installation slots.

21 Claims, 10 Drawing Sheets

ELECTRICAL CONNECTOR

RELATED APPLICATIONS

This application claims priority to Taiwan Application No. 99212956, filed Jul. 7, 2010, and to Taiwan Application No. 99212957, filed Jul. 7, 2010, both of which are incorporated herein by reference in their entirety.

FIELD OF THE INVENTION

The present disclosure relates to an electrical connector, and more specifically to an electrical connector suitable for multi-function applications.

DESCRIPTION OF RELATED ART

Composite electrical connectors, which are intended to meet the usage requirements of multi-functionality and economical volume and are able to conform to a variety of signal transmission standards, have become the trend in the development of electrical connectors. In particular, because signal transmission standards are constantly being updated, composite electrical connectors that can simultaneously handle old and new transmission standards during the transition period from old to new transmission standards are able to increase ease of use.

The signal transmission formats most commonly used at present are USB 2.0, USB 3.0 (USB being an abbreviation for "universal serial bus") and ESATA (which is an abbreviation for "external serial advanced technology attachment"), and for that reason composite socket electrical connectors have been developed into which USB 2.0, USB 3.0 and ESATA plug connectors can be separately plugged, such as that disclosed by Taiwanese Utility Model Publication No. M357748 (corresponding Chinese Patent Application No. 200810173163.4; corresponding U.S. Patent Publication No. US2009111330A1). An embodiment disclosed in Patent No. M357748 is an assembly structure employing a split tongue comprising three types of terminals, wherein the first type of terminal is a terminal for an ESATA connector, the second type of terminal is a terminal for a standard USB 2.0 connector, and the third type of terminal acts with the second type of terminal to form together a terminal for a USB 3.0 connector, the third type of terminal being integrated with the tongue and buried within the tongue, the first type of terminal being installed on the upper surface of the tongue, and the second type of terminal being installed on the lower surface of the tongue. However, the structural strength of the split assembly tongue is comparatively weak due to the comparatively thin thickness thereof; in order to install the second type of terminal, passageways are formed on the tongue perforating through to the posterior of the tongue, causing the strength of the tongue to be even more insufficient and less able to bear insertion/removal force or rotational torque, and conditions of non-normal insertion/removal are prone to result in a state where the tongue is loosened or fractured and so on.

SUMMARY

An electrical connector comprises an housing, a plurality of first terminals, a plurality of second terminals, a plurality of third terminals, and a cage provided on the exterior of the housing. The housing comprises a base and a tongue. The base is provided with a base wall, an assembly slot provided on the base wall and mated to the tongue, the assembly slot perforating the base wall from front to back. The tongue snaps into the assembly slot, and the tongue is provided with a body and a plurality of terminal installation slots recessed downward at intervals from the top surface of the body, the rear end of the terminal installation slots being defined by a boss part. The base further possesses a plurality of first passageways provided on the base wall and corresponding to the terminal installation slots, a yield notch being provided at each location where each terminal passageway corresponds to a boss part. The first terminals are fixed to the housing, and each have an contact positioned to correspond to each terminal installation slot. The second terminals are fixed to the housing, and each have a second contact exposed on top of the body of the tongue and in closer proximity to the front of the tongue than the first terminals. The third terminals are fixed to the housing, and are each provided with a third contact exposed on the bottom of the body of the tongue.

DETAILED DESCRIPTION

Below is provided a detailed description of a preferred embodiment with reference to the drawings, in order to more clearly show the technical content, features and effects of the present utility model, as described above and otherwise. The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated, one benefit of certain depicted embodiments is that because boss parts are formed at the rear end of the terminal installation slots of the tongue, the posterior of the tongue can be made in a block shape which is horizontally integrally connected and thicker, thus allowing the strength of the tongue to be increased. In addition, the front ends of the contacts of the first terminals can be passed over the boss parts of the rear ends of the installation slots by means of the yield notches of the first terminal passageways, thereby facilitating the completion of assembly by entry into the terminal installation slots.

Figure 1:
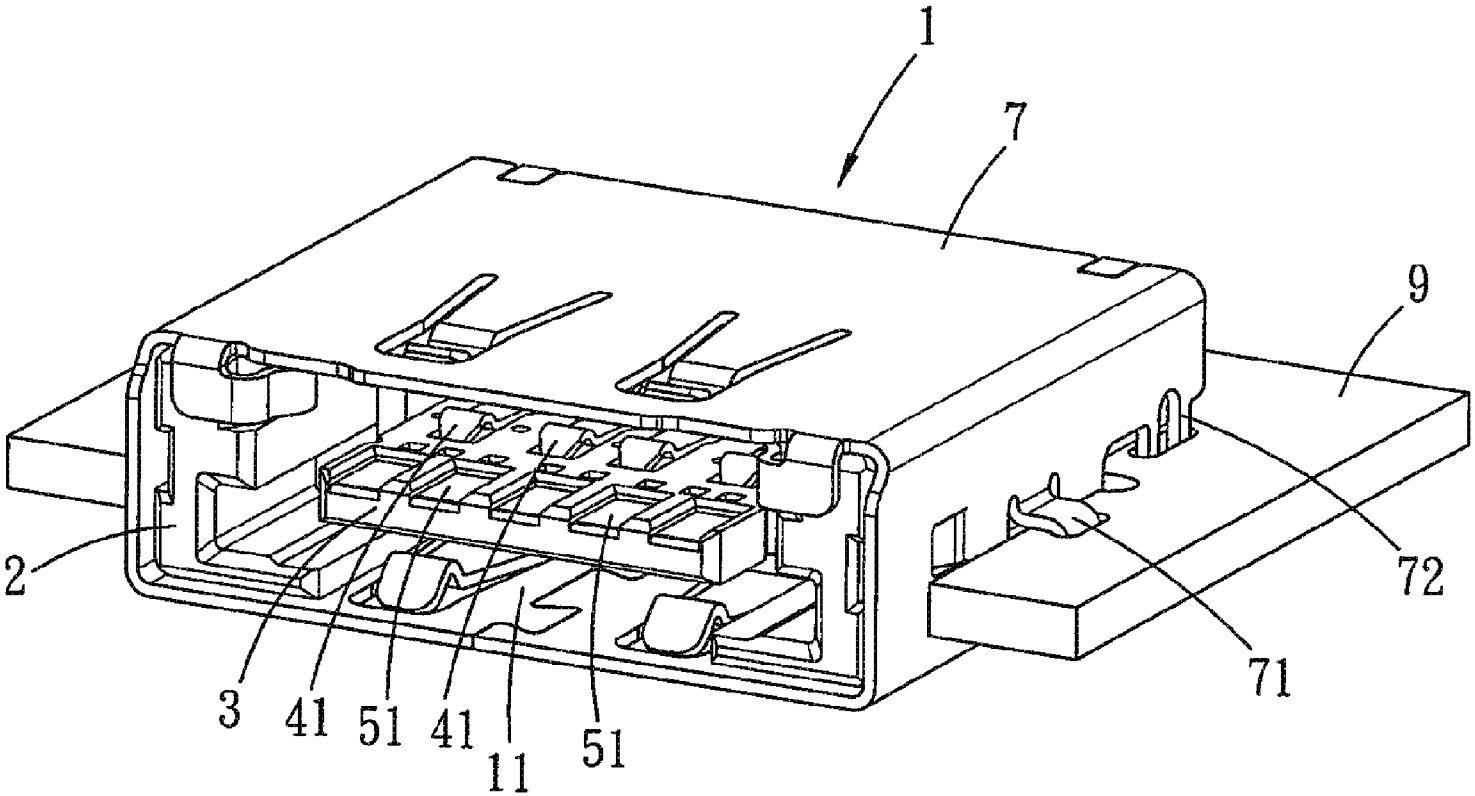
FIG. 1 is a perspective view illustrating an embodiment of an electrical connector and a circuit board.
Figure 2:
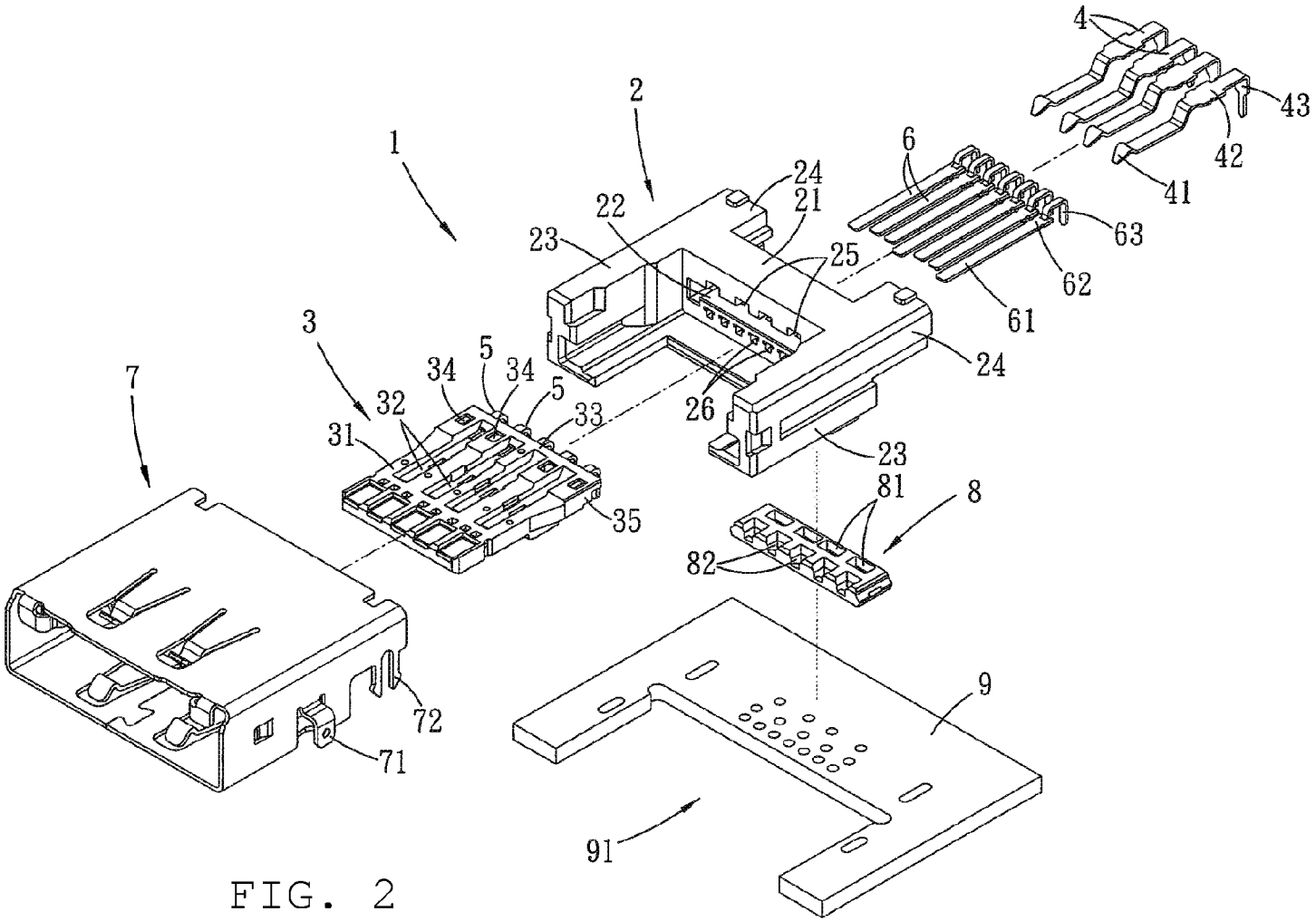
FIG. 2 is a perspective exploded view of FIG. 1.
Figure 3:
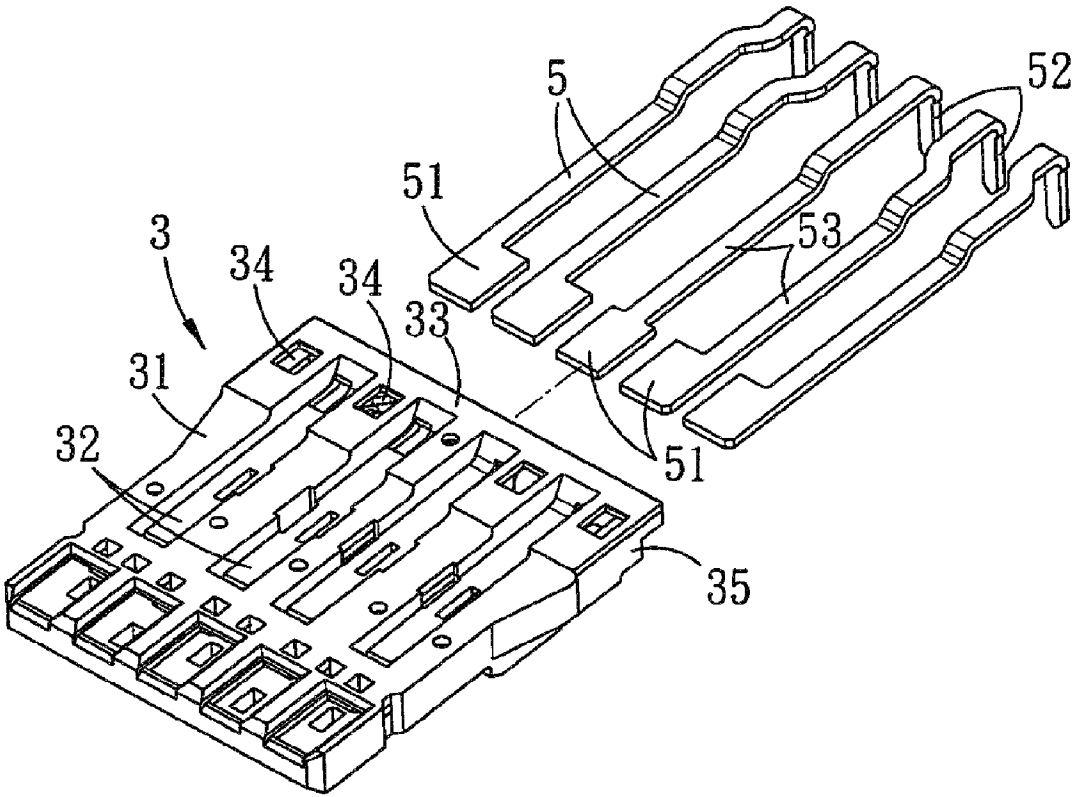
FIG. 3 is a perspective exploded view illustrating the tongue and second terminals depicted in FIG. 2.

As depicted in FIGS. 1-3, an embodiment of the electrical connector is suitable for mounting on a circuit board 9 which is provided with notch 91, whereby electrical connector 1 is partially positioned beneath the board through notch 91. Electrical connector 1 comprises a housing, a plurality of first terminals 4, a plurality of second terminals 5, a plurality of third terminals 6, a cage 7 and terminal positioning board 8.

The housing comprises a base 2 and a tongue 3. The base 2 is provided with a base wall 21 and an assembly slot 22 provided on the base wall 21 and mated to the tongue 3, with the front and back of assembly slot 22 perforating through base wall 21. The base 2 is further provided with two side walls 23 which are each integrally connected to the two forward extensions of the base wall 21 and positioned on both the left and right sides of the tongue 3, and two rear cantilevers 24 which are each integrally connected to both sides of the base wall 21 and extend opposite to the upper portion of each side wall 23 toward the rear. The tongue 3 snaps into the assembly slot 22, and the tongue 3 is provided with a body 31 and a plurality of terminal installation slots 32 which are depressed at intervals downward from the top surface of the body 31, the rear ends of the terminal installation slots 32 being defined by a boss part 33. The posterior of the tongue 3 includes the boss parts 33, which are formed in a block shape which is horizontally integrally connected and thicker, thus the strength of the tongue 3 may be increased.

Figure 4:
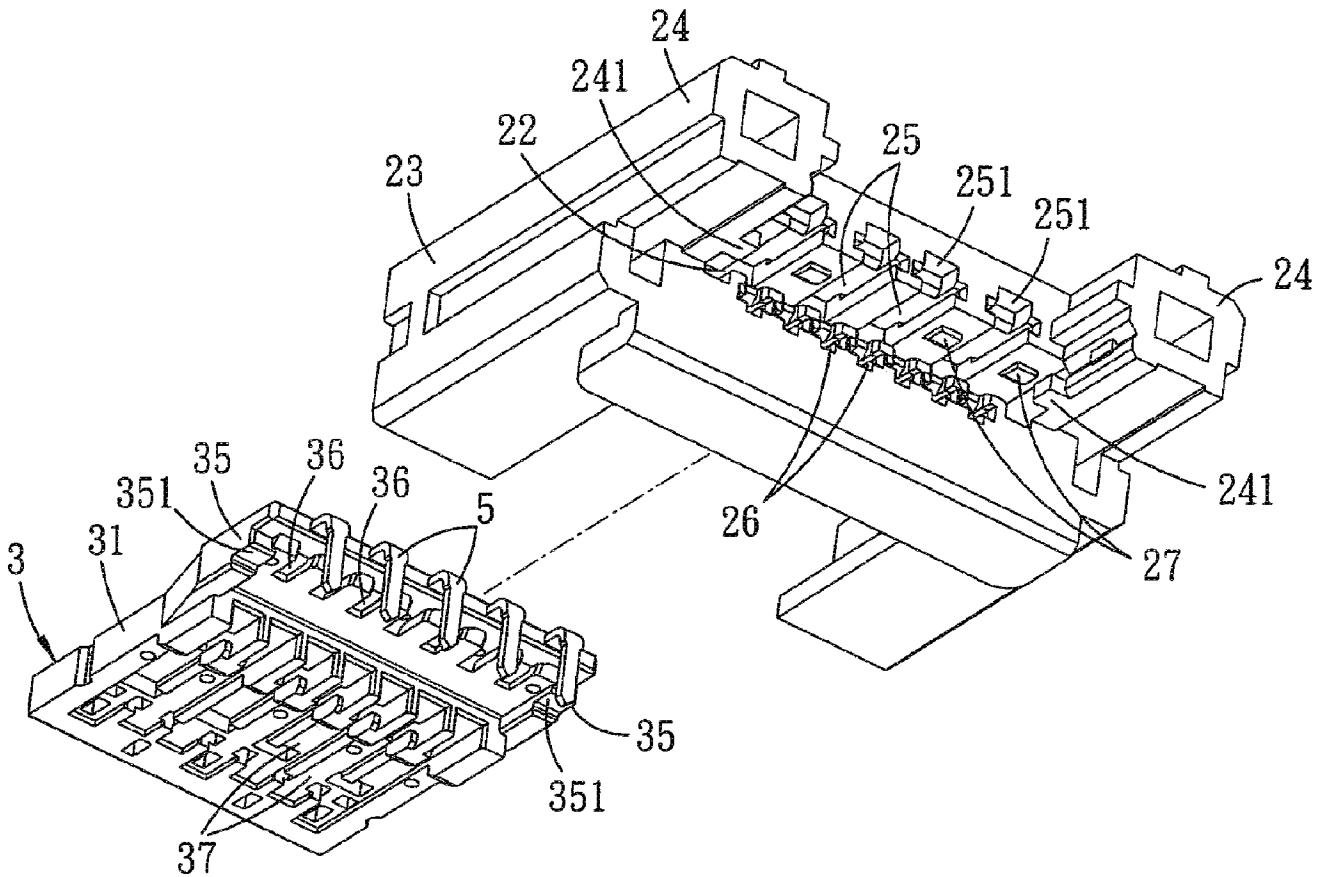
FIG. 4 is a perspective exploded view illustrating the tongue and base depicted in FIG. 2.
Figure 5:
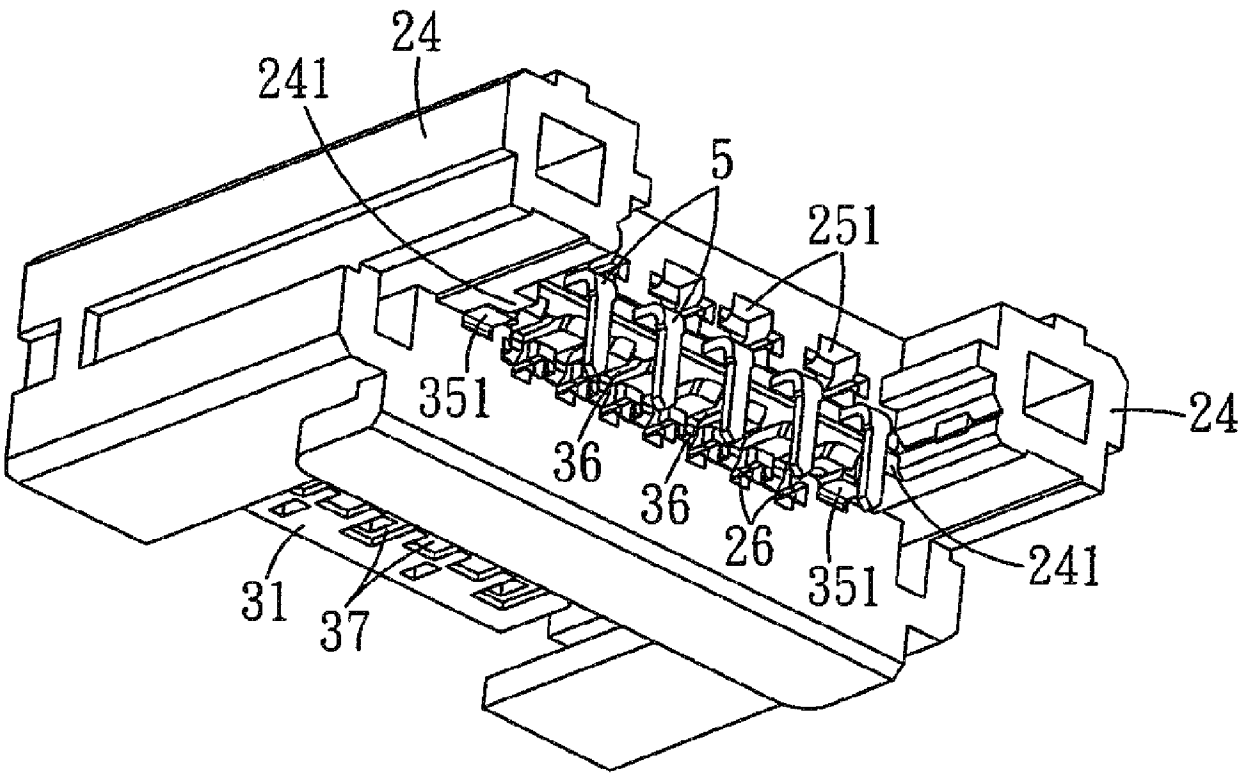
FIG. 5 is an assembled view of FIG. 4.
Figure 6:
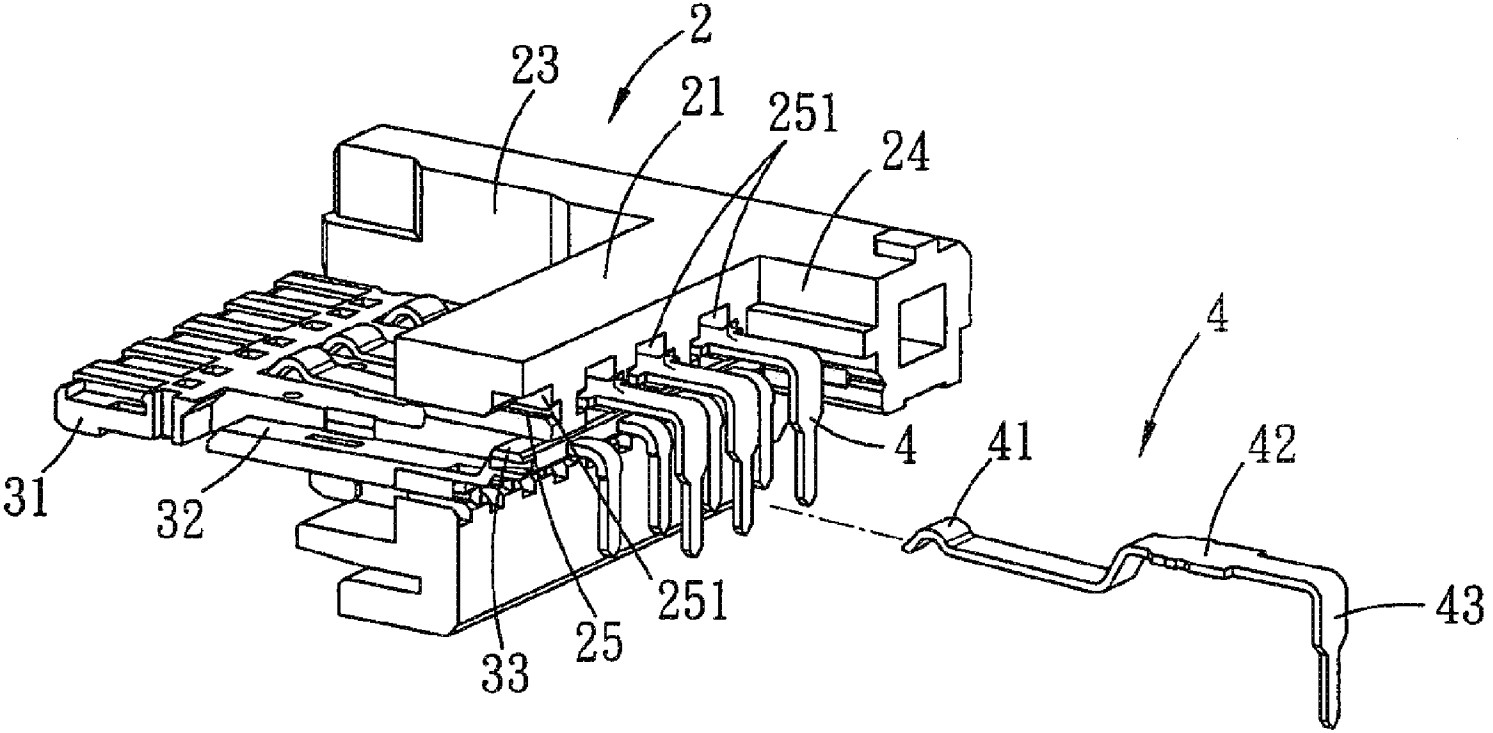
FIG. 6 is a partial perspective exploded view similar to FIG. 5 but with a section thereof removed.

As seen in FIG. 2, FIG. 4 and FIG. 6, the base 2 further possesses a plurality of first terminal passageways 25 provided on the base wall 21 and corresponding to the terminal installation slots 32, a first terminal passageways 25 being positioned above the assembly slot 22 and communicating through the assembly slot 22, and each location where the first terminal passageway 25 corresponds to the boss part 33 being provided with a yield notch 251. The base 2 is further provided with a plurality of third terminal passageways 26 positioned below the assembly slot 22 and respectively corresponding to each third terminal 6, and the tongue 3 further possesses terminal receiving slots 37 provided on the bottom of the body 31 and respectively communicating with each third terminal passageway 26. In addition, as seen in FIGS. 2, 4, 8, and 11, the posterior of the top of the body 31 as well as locations in the base wall 21 positioned within the assembly slot 22 are provided with a plurality of clip slots 34 and clip blocks 27 which are mated to one another. As can be appreciated; the depicted clip slots 34 are located on the tongue 3 and the clip blocks 27 are located on the base 2, but the relative position of the clip slots 34 and the clip blocks 27 are interchangeable.

Also, as seen in FIGS. 4, 5, 8 and 9, the tongue 3 is further provided with two support parts 35 which are separately connected to the posterior of both the left and right of the body 31 and extend backwards convexly out of the assembly slot 22, the bottom of each support part 35 being a support surface 351 which can be propped against the surface of the circuit board 9, thereby increasing the support strength of the tongue 3 and increasing the structural strength thereof. Also, the rear cantilevers 24 can be respectively provided with opposite-facing check blocks 241 extending convexly, such that the back sides of the two support parts 35 are each respectively checked by the check blocks 241, the bottom sides of the two rear cantilevers 24 and the two support surfaces 351 all being supported checked by the surface of the circuit board 9.

As seen in FIGS. 2, 6, 8, and 10, each of the first terminals 4 is fixed to the housing and is provided with an first contact 41 that can flex and is positioned in a corresponding terminal installation slot 32 and is exposed on top of the body 31, a first fixed part 42 extending back from the first contact 41 and fixed to the corresponding terminal passageway 25, and a first connection-guiding part 43 extending downward from first fixed part 42. The assembly thereof is to place the same from the rear side of base 2 forward into first terminal passageway 25 and enable the front end of first contact 41 to pass over boss part 33 of the rear end of terminal installation slot 32 by means of yield notch 251 of first terminal passageway 25, thus easily entering terminal installation slot 32 so as to complete the assembly.

As seen in FIGS. 2, 3, 8 and 12, each second terminal 5 is supported by the housing due to being insert molded into the tongue 3, and is provided with second contact 51 which is exposed on the top surface of body 31 of tongue 3 and is in closer proximity to the front end of tongue 3 than first contacts 41 of terminals 4. A second connection-guiding part 52 extends convexly out from the tongue 3 and extends downward, and a second extension part 53 is connected to the second contact 51 and the second connection-guiding part 52; the second extension part 53 being position in the tongue 3. As can be appreciated, there are five second terminals 5, wherein the second extension part 53 and the second connection-guiding part 52 of the terminal located in the middle thereof extend along the center line of the second contact 51. In addition, the second extension parts 53 of the two leftmost terminals extend leftward toward a rear along the center line of the second contacts 51 corresponding thereto and are offset at the rear end toward the center line, thereby causing the second connection-guiding parts 52 connected thereto to extend along the center line of the second contacts 51 corresponding thereto. The second extension parts 53 of the two rightmost terminals extend rightward toward the rear along the center line of the contacts 51 corresponding thereto and are offset at the rear end toward the center line, thereby causing the second connection-guiding parts 52 connected thereto to extend along the center line of second contacts 51 corresponding thereto and creating equal spacing between the connection-guiding parts 52, such that the spacing between the second extension parts 53 provides spaces equipped with the terminal installation slots 32.

Figure 8:
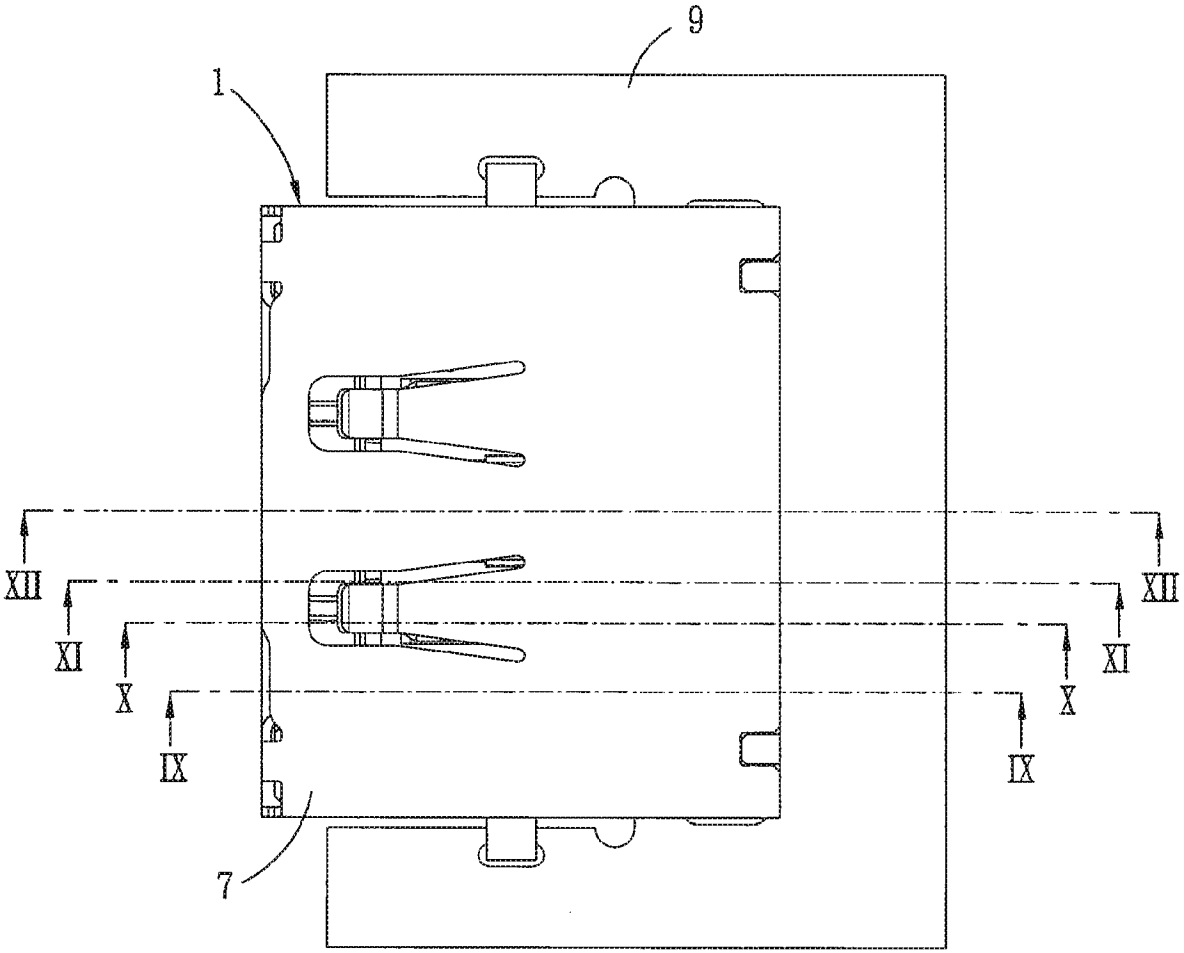
FIG. 8 is a top view of the connector and circuit board depicted in FIG. 1.
Figure 9:
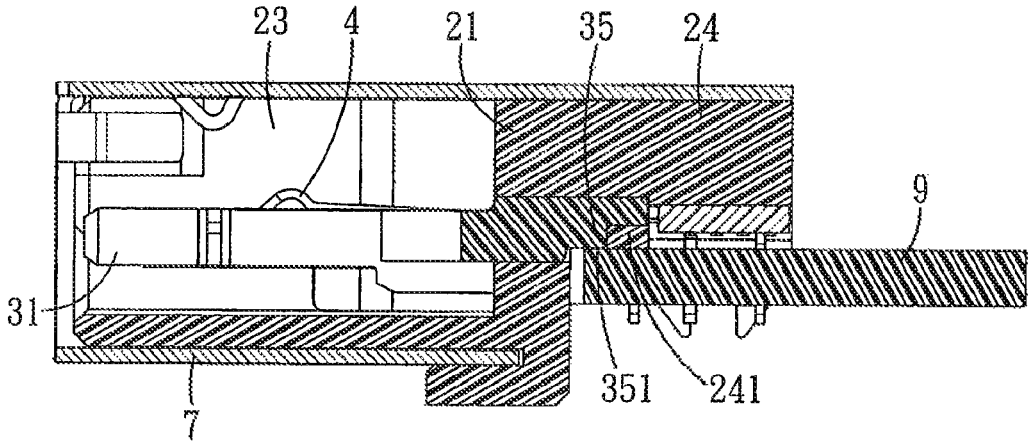
FIG. 9 is a cross-section view taken along the line IX-IX in FIG. 8.
Figure 12:
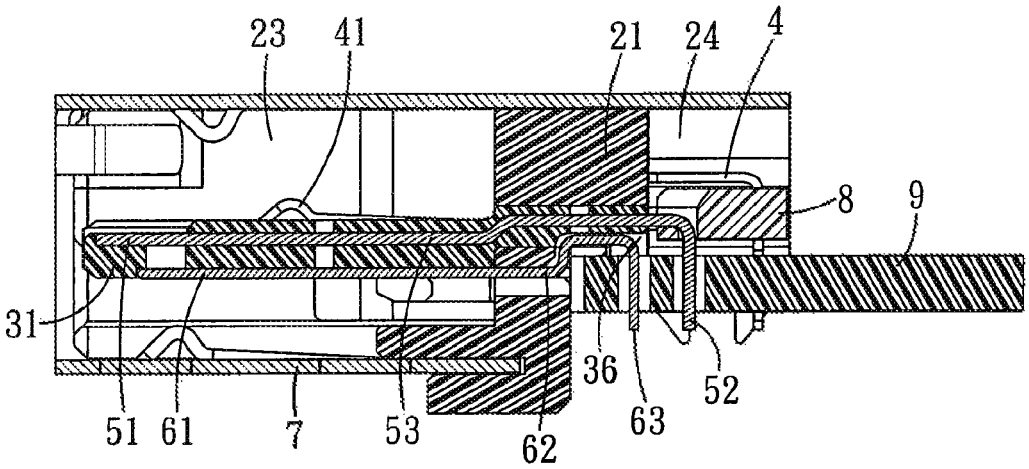
FIG. 12 is a cross-section view taken along the line XII-XII in FIG. 8.

As seen in FIGS. 2, 8, and 12, each third terminal 6 is fixed to the housing and is provided with a third contact 61 exposed on the bottom surface of the body 31. A third fixed part 62 extends toward the rear from the third contact 61 and is fixed into the corresponding third terminal passageway 26 and a third connection-guiding part 63 extends in an inverted U-shaped curve from the third fixed part 62. As depicted, the first terminals 4 are a group of terminals suitable for transmitting signals that conform to the universal serial bus ("USB") 2.0 signal transmission standard, the first terminals 4 act with the second terminals 5 as a group of terminals for transmitting signals that conform to the USB 3.0 signal transmission standard, and the third terminals 6 are a group of terminals configured to transmit signals that conform to an external serial advanced technology attachment ("ESATA") signal transmission standard.

Figure 7:
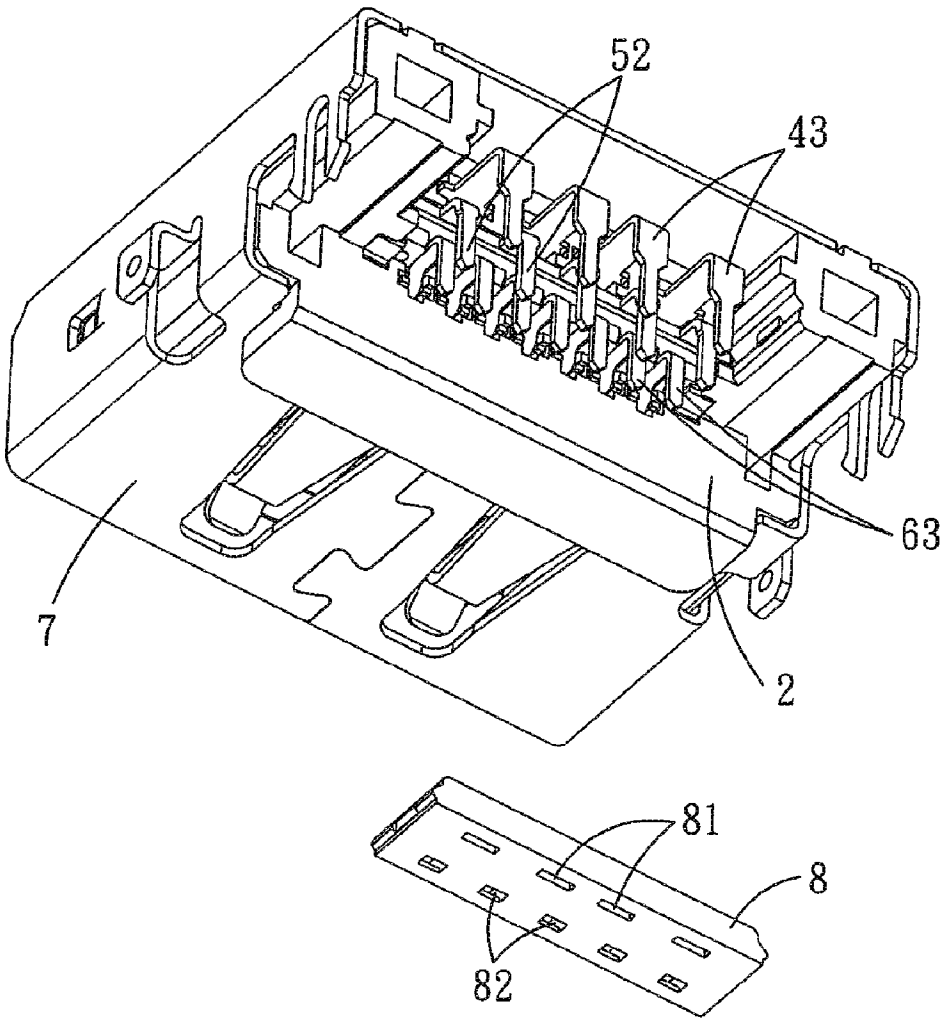
FIG. 7 is a partial perspective exploded view illustrating an embodiment of an electrical connector.
Figure 10:
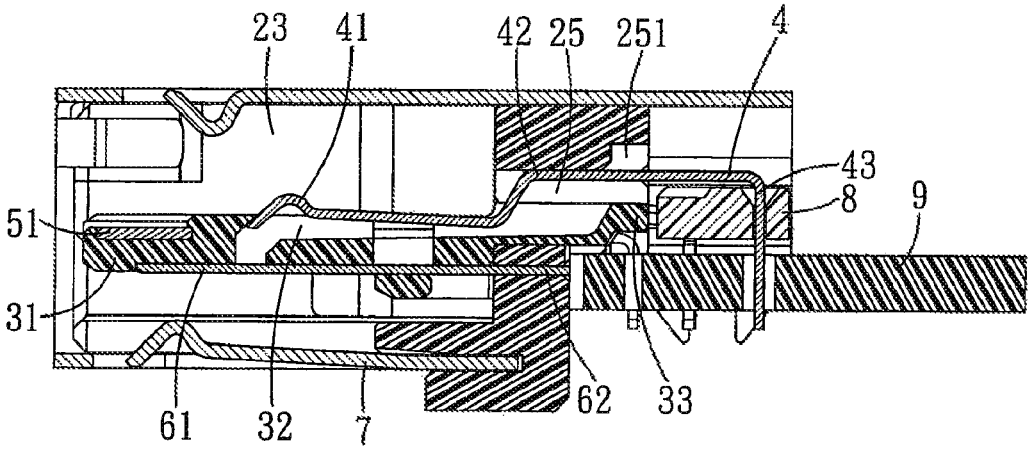
FIG. 10 is a cross-section view taken along the line X-X in FIG. 8.
Figure 11:
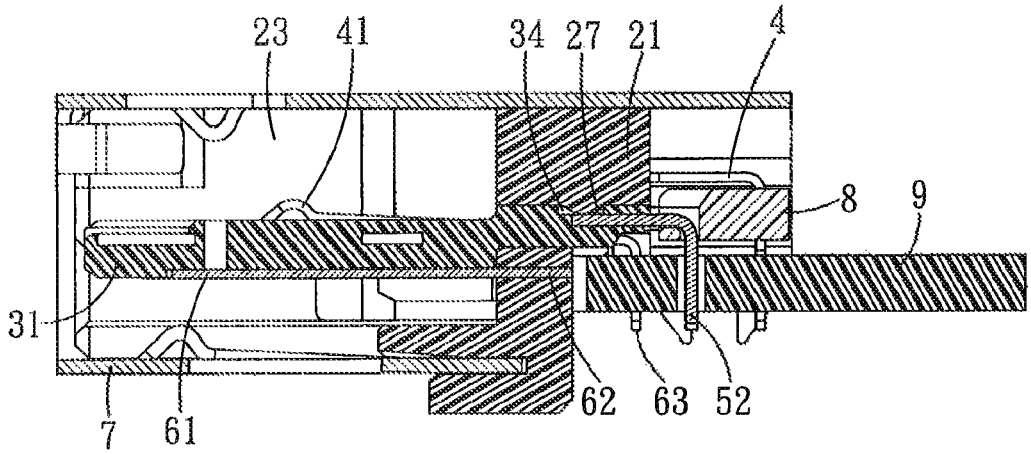
FIG. 11 is a cross-section view taken along the line XI-XI in FIG. 8.

As seen in FIGS. 1, 2, and FIG. 7, the cage 7 is provided on the exterior of the housing and, together with the base 2, defines a plug slot 11, and is provided with two fixed pieces 71 and two dowel pins 72 which are used to fix the cage 7 to the circuit board 9. As seen in FIGS. 7, 10 and 12, a terminal positioning board 8 is provided with two rows of perforations 81, 82 which separate and support first connection-guiding parts 43 of first terminals 4 and second connection-leading parts 52 of second terminals 5 so as to help control the position of the first connection-leading parts 43 and the second connection-guiding parts 52. As seen from FIGS. 4, 5 and FIG. 12, the tongue 3 is further provided with a plurality of positioning slots 36 provided on the bottom side of the posterior of body 31 and positioned at the rear of terminal receiving slots 37 so as to correspondingly fix each third connection-guiding part 63.

In an embodiment, a exemplary method for assembling the electrical connector 1 is to insert the tongue 3 with the second terminals 5 from the front of the base 2 into the assembly slot 22 and fixedly snap the same thereinto, at which point the second connection-guiding parts 52 of the second terminals 5 are bent at the ends and are placed into the rear of the third terminal passageways 26 and the terminal receiving slots 37 from the rear side of the base 2 up until the third terminals 6. Then the second connection-guiding parts 52 are bent; thereafter the first terminals 4 are installed as discussed above. Next, the cage 7 is assembled to the base 2 from the front side of base 2 towards the rear, and then the terminal positioning board 8 is snapped into base 2. As shown in FIG. 1, the completely assembled electrical connector 1 can then be installed onto the circuit board 9 to form a recessed style connector wherein a portion is positioned above the board and a portion is positioned below the board.

In an exemplary embodiment, because the boss parts 33 are formed at the rear ends of the terminal installation slots 32, the posterior of the tongue 3 is made to be a block shape which is horizontally integrally connected and thicker, thus the strength of tongue 3 may be increased. In addition, the front ends of the first contacts 41 of the first terminals 4 are made to pass over the boss parts 33 of the rear ends of the terminal installation slots 32 due to the yield notches 251 of the first terminal passageways 25, thereby facilitating entry into the terminal installation slots 32. Also, the support surfaces 351 of can be supported by the surface of the circuit board 9, whereby the support and structural strength of the tongue 3 is increased.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. An electrical connector, comprising:

an housing comprising a base and a tongue, the base including a base wall and an assembly slot provided on the base wall for receiving the tongue, the assembly slot perforating the base wall at the front and back, the tongue positioned into the assembly slot, the tongue being provided with a body and a plurality of terminal installation slots depressed downwards at intervals from the top surface of the body, the rear ends of the terminal installation slots being defined by boss parts, the base further possessing a plurality of first terminal passageways provided on the base wall and corresponding to each terminal installation slot, and each location at which the first terminal passageways correspond to the boss parts being provided with a yield notch;

a plurality of first terminals fixed to the housing, each of the first terminals being provided with an contact positioned in a corresponding terminal installation slot;

a plurality of second terminals fixed to the housing, each of the second terminals being provided with a second contact exposed on the top of the tongue and being in closer proximity to the front end of the tongue than the first terminals;

a plurality of third terminals fixed to the housing, each of the third terminals being provided with a third contact exposed on the bottom surface of the body of the tongue; and a cage provided on the exterior of the housing.

2. The electrical connector according to claim 1, wherein the tongue includes two support parts separately connected to both the left and right sides of the posterior of the body and convexly extended backwards out of the assembly slot, wherein a bottom surface of each of the support parts having a support surface configured to be positioned against a surface of a circuit board.

3. The electrical connector according to claim 2, wherein the second terminals are insert-molded in the tongue and are each provided with a second connection-guiding part extending convexly out from the rear of the tongue and extending downward and a second extension part connected to the second contact and the second connection-guiding part; there being a total of five of the second terminals, wherein the second extension part and second connection-guiding part of the terminal located in the middle thereof extend along the center line of the second contact; the second extension parts of the two leftmost terminals extend leftward toward the rear along the center line of the second contacts corresponding thereto and are offset at the rear end toward the center line, causing the second connection-guiding parts connected thereto to extend along the center line of the second contacts corresponding thereto; the second extension parts of the two rightmost terminals extend rightward toward the rear along the center line of the contacts corresponding thereto and are offset at the rear end toward the center line, causing the second connection-guiding parts connected thereto to extend along the center line of the second contacts corresponding thereto.

4. The electrical connector according to claim 2, wherein the first terminals are a group of terminals for transmitting signals that conform to the USB 2.0 signal transmission standard, the first terminals act with the second terminals as a group of terminals for transmitting signals that conform to the USB 3.0 signal transmission standard, and the third terminals are a group of terminals for transmitting signals that conform to the ESATA signal transmission standard.

5. The electrical connector according to claim 2, wherein the posterior of the body of the tongue and locations in the base wall of the base positioned within the assembly slot are respectively provided with a plurality of clip slots and clip blocks which are mated to one another.

6. The electrical connector according to claim 2, wherein the first terminal passageways are positioned above the assembly slot and communicate with the assembly slot, the base being further provided with a plurality of third terminal passageways located below the assembly slot, the third terminal passageways each corresponding to one of the third terminals.

7. The electrical connector according to claim 6, wherein each first terminal is provided with a first fixed part extending backwards from the contact and fixed to the corresponding first terminal passageway, and a first connection-guiding part extending downward from the first fixed part, each third terminal being further provided with a third fixed part extending backwards from the third contact and fixed to the corresponding third terminal passageway, and a third connection-guiding part extending in an inverted U curve from the third fixed part.

8. The electrical connector according to claim 7, wherein the tongue further possesses a plurality of positioning slots provided on the bottom of the posterior of the body so as to correspondingly fix each third connection-guiding part.

9. The electrical connector according to claim 2, wherein the base is further provided with two side walls which are each connected to the two forward extensions of the base wall and positioned on both the left and right sides of the tongue, and two rear cantilevers which are each connected to both sides of the base wall and extend opposite to the upper portion of each side wall toward the rear, the bottom sides of both the rear cantilevers and both support surfaces of the tongue being propped against the surface of a circuit board.

10. The electrical connector according to claim 9, wherein the rear cantilevers are provided with respective opposite-facing check blocks extending convexly, the rear sides of both support parts of the tongue being separately checked by the check blocks.

11. The electrical connector according to claim 9, wherein the electrical connector is configured to be installed onto a circuit board provided with a notch, wherein, in operation, the electrical connector is partially positioned in the notch so as to extend beneath the circuit board such that the bottom of the two rear cantilevers of the base and the two support surfaces of the tongue can simultaneously be supported by a surface of the circuit board.

12. An electrical connector, comprising:

an housing comprising a base and a tongue, the base possessing a base wall and an assembly slot provided on the base wall and mated to the tongue, the assembly slot perforating the base wall at the front and back, the tongue pressed into the assembly slot and being provided with a body and two support parts separately connected to both the left and right sides of the posterior of the body and convexly extended backwards out of the assembly slot, and the bottom surface of each of the support parts being a support surface able to be propped against the surface of the circuit board;

a plurality of first terminals fixed to the housing, each of the first terminals being provided with a contact exposed on the top of the body;

a plurality of second terminals fixed to the housing, each of the second terminals being provided with a second contact exposed on the top of the body of the tongue and being in closer proximity to the front end of the tongue than the first terminals;

a plurality of third terminals, fixed to the housing, each of the third terminals being provided with a third contact exposed on the bottom surface of the body of the tongue; and a metal housing provided on the exterior of the housing.

13. The electrical connector according to claim 12, wherein the base is further provided with two side walls which are each connected to the two forward extensions of the base wall and positioned on both the left and right sides of the tongue, and two rear cantilevers which are each connected to both sides of the base wall and extend opposite to the upper portion of each side wall toward the rear, the bottom sides of both the rear cantilevers and both support surfaces of the tongue being propped against the surface of a circuit board.

14. The electrical connector according to claim 13, wherein the rear cantilevers are provided with respective opposite-facing check blocks extending convexly, the rear sides of both support parts of the tongue being separately checked by the check blocks.

15. The electrical connector according to claim 13, wherein the second terminals are buried in the tongue by means of in-mold insert-molding and are furthermore each provided with a second connection-guiding part extending convexly out from the tongue and extending downward and a second extension part connected to the second contact and the second connection-guiding part, there being a total of five of the second terminals, wherein the second extension part and second connection-guiding part of the terminal located in the middle thereof extend along the center line of the second contact; the second extension parts of the two leftmost terminals extend leftward toward the rear along the center line of the second contacts corresponding thereto and are offset at the rear end toward the center line, causing the second connection-guiding parts connected thereto to extend along the center line of the second contacts corresponding thereto; the second extension parts of the two rightmost terminals extend rightward toward the rear along the center line of the contacts corresponding thereto and are offset at the rear end toward the center line, causing the second connection-guiding parts connected thereto to extend along the center line of the second contacts corresponding thereto.

16. The electrical connector according to claim 13, wherein the posterior of the body of the tongue as well as locations in the base wall of the base positioned within the assembly slot are provided with a plurality of clip slots and clip blocks which are mated to one another.

17. The electrical connector according to claim 13, wherein the first terminals are a group of terminals for transmitting signals that conform to the USB 2.0 signal transmission standard, the first terminals act with the second terminals as a group of terminals for transmitting signals that conform to the USB 3.0 signal transmission standard, and the third terminals are a group of terminals for transmitting signals that conform to the ESATA signal transmission standard.

18. An electrical connector assembly, comprising:

a circuit board with a notch and a first surface; and an electrical connector according to claim 13 installed onto the circuit board in the notch such that a portion of the electrical connector is positioned above the circuit board and a portion is positioned below the circuit board, and such that the support surfaces of the two support parts of the tongue are supported by the first surface.

19. The electrical connector assembly according to claim 18, wherein the base is further provided with two side walls which are each connected to the forward extensions of both sides of the base wall and positioned on both the left and right sides of the tongue, and two rear cantilevers which are each connected to both sides of the base wall and extend opposite to the upper portion of each side wall toward the rear, the bottom side of the two cantilevers and the two support surfaces of the tongue all being propped against the surface of the circuit board.

20. The electrical connector assembly according to claim 19, wherein the cantilevers are respectively provided with opposite-facing check blocks extending convexly, the rear sides of both support parts of the tongue being checked by the check blocks.

21. The electrical connector assembly according to claim 19, wherein the first terminals are a group of terminals for transmitting signals that conform to the USB 2.0 signal transmission standard, the first terminals act with the second terminals as a group of terminals for transmitting signals that conform to the USB 3.0 signal transmission standard, and the third terminals are a group of terminals for transmitting signals that conform to the ESATA signal transmission standard.

* * * * *